United States Patent [19]

Green

[11] 4,162,943

[45] Jul. 31, 1979

[54] SLOT PYROLYSIS REACTOR AND METHOD OF PYROLYSIS

[75] Inventor: Norman W. Green, Upland, Calif.

[73] Assignee: Occidental Petroleum Corporation, Los Angeles, Calif.

[21] Appl. No.: 848,711

[22] Filed: Nov. 4, 1977

Related U.S. Application Data

[63] Continuation of Ser. No. 699,995, Jun. 25, 1976, abandoned.

[51] Int. Cl.[2] ..... B04C 5/04; C10B 1/04; C10B 49/16

[52] U.S. Cl. ..... 201/12; 48/77; 55/419; 55/459 R; 201/22; 201/26; 201/28; 201/29; 201/31; 201/36; 201/43; 202/99; 202/121; 208/8 R

[58] Field of Search ..... 201/8, 10, 12, 21, 22, 201/26, 28, 29, 31, 36, 43; 202/81, 82, 96, 99, 113, 120, 121; 48/77, 101, 210; 208/8, 11 R; 55/419, 459 R

[56] References Cited

U.S. PATENT DOCUMENTS

| | | | |
|---|---|---|---|
| 1,473,491 | 11/1923 | Manning | 202/121 X |
| 2,767,840 | 10/1956 | Dobson et al. | 209/144 |
| 2,829,955 | 4/1958 | Goedkoop | 201/26 X |
| 2,935,466 | 5/1960 | Schoenmakers | 23/288 S X |
| 3,151,961 | 10/1964 | Blackmore et al. | 55/459 R UX |
| 3,171,795 | 3/1965 | Fagnant | 202/108 X |
| 3,562,143 | 2/1971 | Jagel, Jr. et al. | 201/29 X |
| 3,637,464 | 1/1972 | Walsh et al. | 201/23 X |
| 3,867,110 | 2/1975 | Schora et al. | 48/210 |
| 3,957,459 | 5/1976 | Mitchell et al. | 201/31 X |
| 3,988,210 | 10/1976 | Pikon et al. | 48/101 X |

*Primary Examiner*—Joseph Scovronek

*Attorney, Agent, or Firm*—Max Geldin; William N. Patrick; William G. Lane

[57] ABSTRACT

Apparatus for conducting the flash pyrolysis of a primary material, particularly coal, and employing a secondary material, particularly hot char, as a heat source, comprising a rectangular slot for injection of a stream of particulate coal, which communicates with a substantially rectangular reactor or pyrolysis chamber. Wells are positioned on opposite sides of the pyrolysis chamber and in communication therewith, for introduction of fluidized secondary material, particularly hot char, into the pyrolysis chamber for admixture therein with and for heating the stream of primary material, such as coal. The pyrolysis chamber has a transition chamber, and a cylindrical separator chamber communicates with the transition chamber for receiving pyrolysis products. The separator chamber is provided with a tangential inlet, a solids outlet conduit positioned about 90° around the circumference of the separator chamber from the tangential inlet, and a perforate gas receiver. The process for flash pyrolysis of a particulate primary material, such as coal, utilizing apparatus as described above.

36 Claims, 9 Drawing Figures

Fig. 1
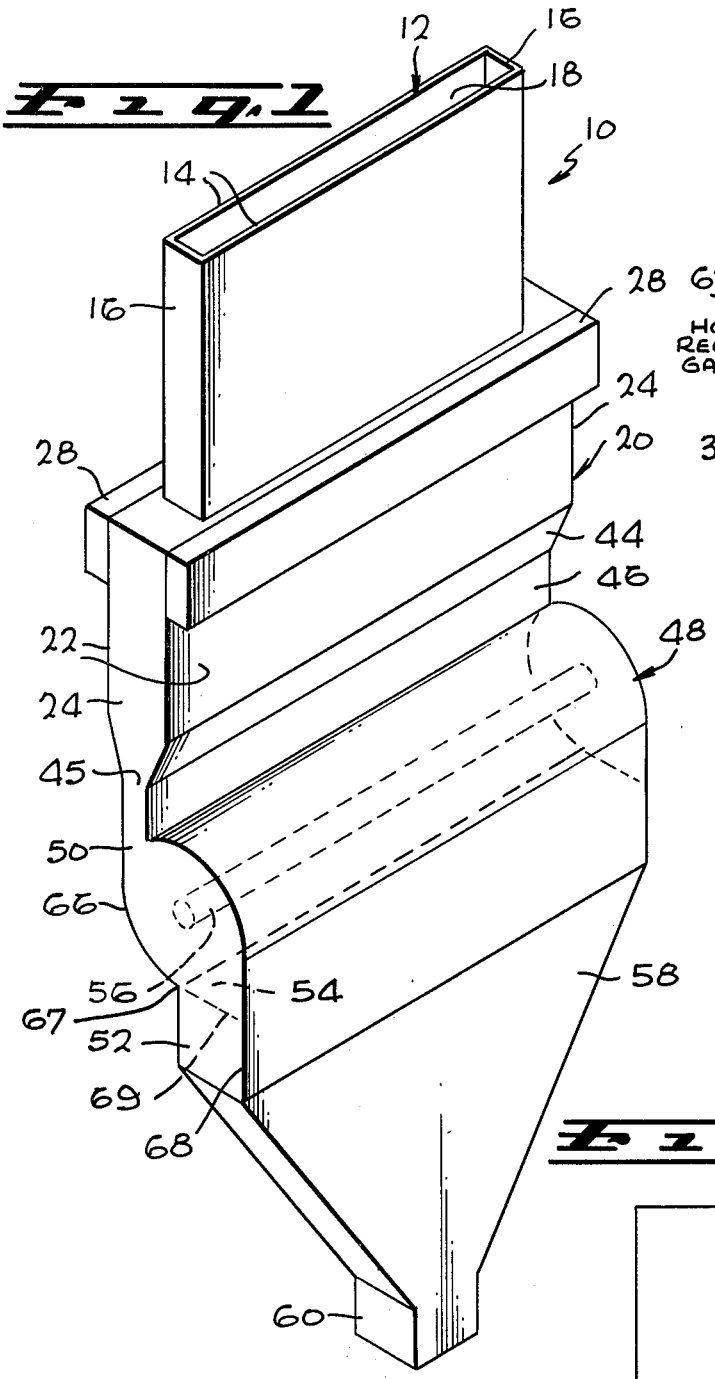
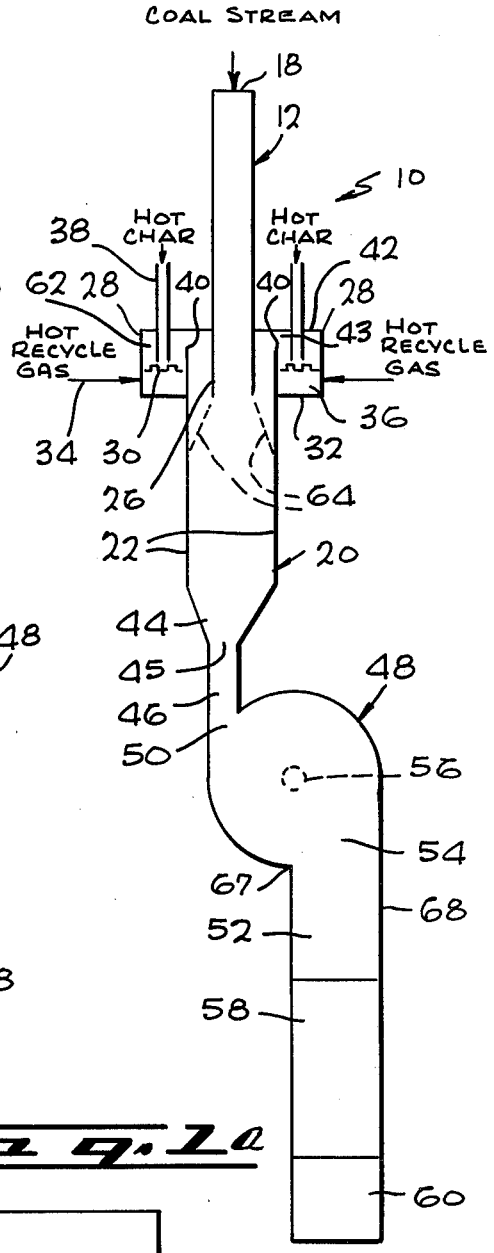
Fig. 1a
Fig. 2
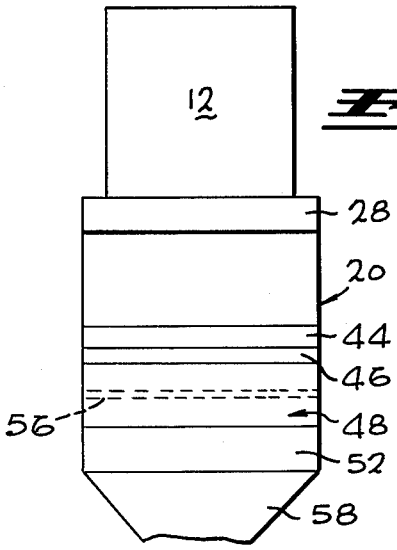
Fig. 6
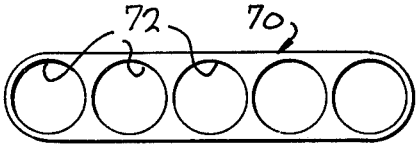

Fig. 3
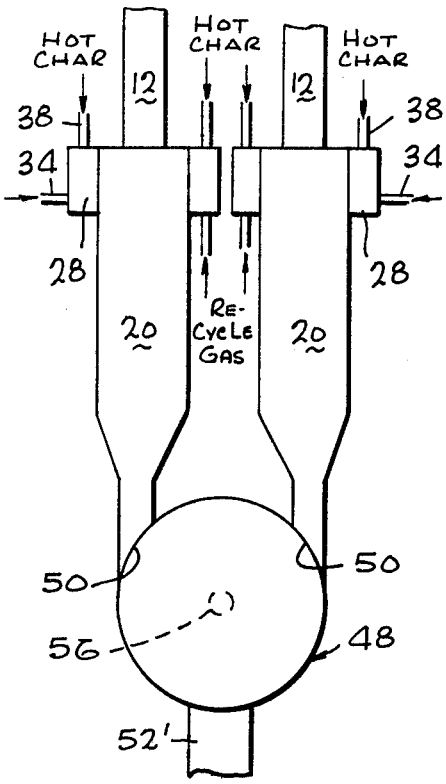
Fig. 4
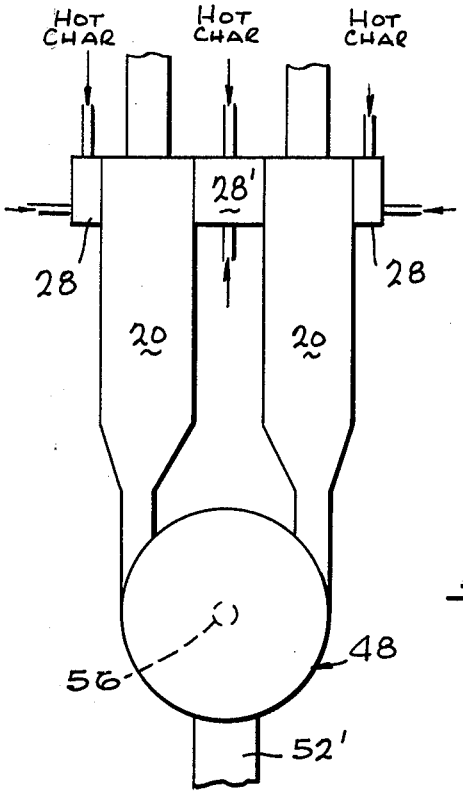
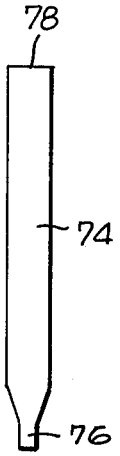
Fig. 7
Fig. 5
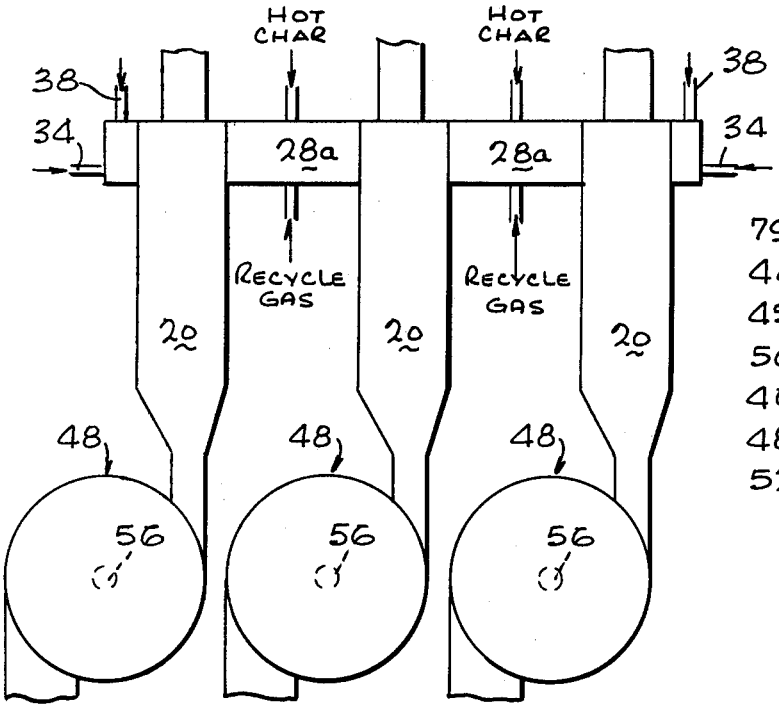
Fig. 8
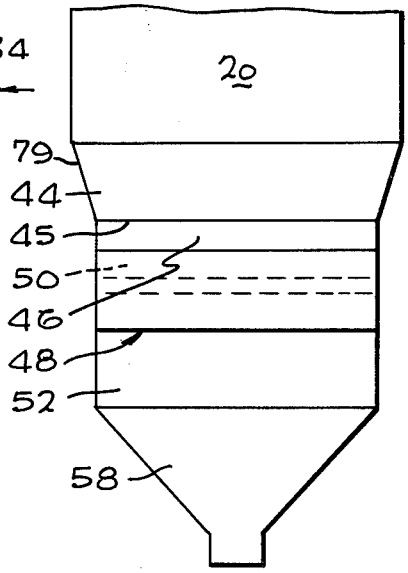

SLOT PYROLYSIS REACTOR AND METHOD OF PYROLYSIS

This is a continuation of application Ser. No. 699,995, filed June 25, 1976, now abandoned.

BACKGROUND OF THE INVENTION

The present invention relates to apparatus and a method for pyrolysis of a primary material, such as coal, preferably utilizing a second material such as hot char as a heat source, and more particularly is directed to apparatus for flash pyrolysis of particulate coal, and utilizing particulate hot char, employing components having a geometry or shape which affords simpler and more feasible "scaling up" of the apparatus design for commercial application, and which also provides additional advantages.

For a process that is essentially plug flow in nature, that is, wherein the reactor components are mixed in a pyrolysis chamber in a radial rather than in an axial direction, and the resulting mixture has uniform composition and properties at any cross section of the reactor, selection of the geometry of the apparatus is not critical for purposes of "scaling up" for commercial application. For example, if the residence time of the materials in a pyrolysis reactor is a function of the length of the reactor, throughput is increased by increasing the cross section of the reactor. Thus, in the period of time between rapid heating, that is mixing of the particulate materials in the reactor and solids separation, the selection of a particular geometry for the reactor cross-section is relatively unimportant. However, the rapid heating and solids separation operations, are not plug flow in nature.

If a circular geometry is selected for the cross section of the reactor, a reactor design could be selected of the type disclosed and claimed in my application Ser. No. 633,898, filed Nov. 20, 1975, which is a continuation of Ser. No. 449,073 filed Mar. 7, 1974, now abandoned, in the form of a coaxial jet mixer for mixing and pyrolysis of a primary material source such as particulate coal, utilizing a secondary material such as particulate char as a heat source, a tubular reactor and a conventional cyclone receiver. In an apparatus of this type a coal stream is introduced through an inlet such as a nozzle into a fluidized annular stream of char, and the turbulent mixture pyrolyzed in the tubular pyrolysis reactor. As such design is scaled up to higher throughputs, the mixing time is increased and the separation time in the cyclone is increased. Although this can be compensated to some degree by permitting multiple injection systems and multiple cyclones or collectors, the benefits of this additional apparatus is marginal and the overall symmetry is disrupted.

It is an object of the present invention to provide a novel apparatus and method for pyrolysis of particulate materials, such as coal.

A further object of the present invention is to provide apparatus and a method of such type which involves the use of non-circular or non-tubular material feeding and pyrolysis reactor components.

A still further object of the present invention is to provide apparatus and a method of the above type employing a novel pyrolysis products separator design providing rapid separation of solids from gases, and incorporating means in such separator for collecting and withdrawing pyrolysis gases.

SUMMARY OF THE INVENTION

The present invention affords a simpler, more direct and practical solution to the problem of "scaling up" a pyrolysis reactor design while insuring that the residence times chosen for the mixing and rapid heating of the pyrolysis reactants, and the separation operations following pyrolysis, are at the optimum for the commercial design.

According to the invention, there is provided the concept of rectangular slot injection of the primary material which is to be pyrolyzed, such as particulate coal, and mixing thereof with the secondary material serving as heat source such as fluidized char, resulting in a substantially rectangular geometry for the pyrolysis reactor. Thus, according to the invention concept, a high velocity slot jet or slot stream of particulate coal, by which is meant a stream having a rectangular cross section in a horizontal plane, is injected into a rectangular reactor. Such slot can be continuous in phase or it may be formed from a number of circular ducts positioned to approximate the geometry of a slot. Once an optimum slot width has been chosen, "scale up" can be accomplished simply by expanding the feed slot length or by stacking a plurality of slot pyrolysis reactors or modules, according to the invention, in parallel.

The secondary material, such as particulate char, used as a heat source for pyrolysis of the coal, is introduced into wells, particularly a pair of wells positioned on either side of the substantially rectangular reactor, wherein the char is fluidized, and the fluidized char is caused to overflow the wells into a mixing zone, wherein the turbulent slot jet or sheet stream of particulate coal, is mixed with the fluidized char. The resulting jet stream of particulate coal and entrained particulate char is conveyed downwardly through the rectangular reactor for pyrolysis therein, the reactor terminating preferably in a rectangular transition member to decrease the rectangular cross section of the stream of pyrolysis products and reduce the volume thereof, to thereby facilitate introduction of the pyrolysis products into the separator. The mixture of pyrolysis products passing into the separator thus has increased velocity due to reduction in volume thereof as noted above.

The separator is of cylindrical design and has as an essential feature a tangential inlet for introduction of pyrolysis products, such inlet communicating with the above noted transition member, a tangentially disposed solids outlet conduit from the separator, and a porous or perforated gas receiver member mounted within the separator. In a preferred embodiment, the solids outlet conduit is positioned not more than about 180° around the circumference of the separator from the tangential inlet so that the solid pyrolysis products or char solids, following introduction into the separator from the tangential inlet, preferably are caused to travel not more than half the circumference of the separator, most desirably about one fourth of the circumference of the separator, before impacting the wall of the solids receiver or outlet conduit and being removed from the separator. Pyrolysis gases are withdrawn from one or both ends of the perforated gas receiver, which is preferably in the form of a perforated tube axially within the separator. This separator design results in reduced residence time of the solids and gases in the separator, and more rapid separation than in conventional cyclones, minimizing contact of gases with solids and minimizing the time the gases are held at elevated temperatures before quenching.

A number of variations of the basic reactor design described above can be provided to accomplish the desired results. Thus, for example a plurality of such rectangular reactors including the slotted feed member and cylindrical separator, can be stacked in parallel with the fluidization wells for the char each serving adjacent pairs of reactors. Further, each of the separators can be provided with opposed tangential inlets to serve a pair of reactors. Also, the porous gas receiver can be designed to act catalytically on the volatiles stream.

THE DRAWINGS

The above and other features and advantages of the invention will be more clearly understood by reference to the following detailed description of the invention, taken in connection with the accompanying drawings wherein:

FIG. 1 is a perspective view of a preferred embodiment of pyrolysis reactor design according to the invention;

FIG. 1*a* is a view in elevation of the reactor design of FIG. 1;

FIG. 2 is a longitudinal section through the pyrolysis reactor of FIG. 1;

FIG. 3 is a modification of the invention apparatus, showing a pair of reactor modules stacked in parallel with opposed tangential inlets to a single separator;

FIG. 4 is a modification similar to that of FIG. 3, but wherein one of the fluid-bed wells for the fluidized char serves two reactors;

FIG. 5 is still another modification of the invention, employing a plurality of stacked parallel reactors each having its own feed slot for primary material such as particulate coal, and its own separator, but wherein the wells for the fluidized secondary material such as char serve adjacent reactors;

FIG. 6 illustrates formation of the feed slot from a number of circular ducts positioned together to approximate the geometry of a feed slot;

FIG. 7 illustrates a modified form of slot for feeding the primary material, that is a particulate coal stream, to the reactor; and FIG. 8 is a view similar to FIG. 1*a*, and showing a further modification.

DESCRIPTION OF PREFERRED EMBODIMENTS

Referring to FIGS. 1, 1*a* and 2, numeral 10 designates a preferred form of slot reactor according to the invention.

The feed slot of the slot reactor 10 comprises a hollow rectangular member 12 formed of a pair of parallel sides 14 and parallel end members 16, providing a slot 18 of rectangular cross section from the top to the bottom of member 12.

The rectangular member 12 forming the slot 18 is vertically mounted on a pyrolysis reactor 20, also of rectangular shape and having parallel sides 22 and parallel end walls 24. The length of the pyrolysis reactor cross section, as best seen in FIGS. 1 and 1*a*, between end walls 24, is greater than the length of member 12 between end members 16, and of slot 18, and the width of the reactor cross section is greater than the width of the member 12 and of slot 18 therein. The lower portion 26 of rectangular member 12 and the slot 18 thereof extends into the upper end portion of the reactor 20.

A pair of rectangular shaped wells 28 are mounted on either side of the upper end portion of the pyrolysis reactor, and extend from one end wall 24 of the pyrolysis reactor to the opposite end wall 24 thereof. Each of these walls is provided with a horizontal grid or perforated plate 30 mounted across and spaced from the bottom 32 of the well, and a gas inlet 34 is provided to the chamber 36 formed in the bottom of the well below the plate or grid 30. A vertical stand pipe 38 is mounted in each of the wells 28 and terminates at its lower end a short distance above the grid 30. The upper ends 40 of the sides 22 of the reactor 20, forming the inner walls of the wells 28, terminate below the top 42 of the reactor, leaving a slot 43 above the upper ends 40 of reactor sides 22 for communication between the wells 28 and the space in the upper portion of the reactor between the upper end portions of reactor sides 22 and the lower depending end portion 26 of the member 12, for a purpose described more fully hereinafter.

The rectangular reactor has a downwardly tapered transition portion 44 which terminates in a rectangular slot 45 of substantially reduced cross section as compared to the cross section of the reactor 20. An inlet pipe 46 from the transition portion 44 facilitates introduction of pyrolysis products into a separator 48. The separator 48 is in the form of a horizontally disposed tube or cylinder having an axial length equal to the horizontal length of the members 44 and 46.

Members 12, 20, 28, 44 and 46 have been designated as being rectangular, by which is meant that such components have a rectangular cross section in a horizontal plane.

The separator 48 has a feature thereof a tangential rectangular inlet 50 from the inlet pipe 46, which extends substantially the entire length of the separator, and is of the same length as the slot 45. A solids outlet duct 52 is connected to the lower portion of the separator 48 and extends tangentially downwardly therefrom, it being noted that the inlet 54 to the duct 52 is tangentially disposed with respect to the cylindrical separator 48, opposite inlet 50, and extends circumferentially around the separator 48 from a position extending from 90° to 180° from the position of the tangential inlet 50 to the separator. The positioning of the tangential inlet 50 to the separator and the inlet 54 from the separator to duct 52 are for purposes noted hereinafter. The separator 48 also is provided with an axially positioned porous or perforated cylindrical gas receiver 56 for removal of gases from opposite ends thereof.

The solids outlet duct 52 communicates with a downwardly tapered chamber 58 which in turn communicates with a solids collecting chamber 60.

In operation, a primary material such as particulate coal in a suitable carrier gas such as an inert gas e.g. nitrogen, or hot recycle gas, methane or carbon monoxide, and substantially free of molecular oxygen, is injected as a high velocity stream, and generally having a Reynolds number greater than about 2,000, through the slot 12 and into the upper portion of the rectangular reactor 20. A secondary material such as hot particulate recycled char at high temperatures is fed from the inlet or stand pipes 38 of each of the wells 28 into a fluidization chamber 62. The char is rendered fluid by a suitable fluidizing gas, e.g. nitrogen or hot recycle gas, introduced at 34 and which passes through the grid or plate 30 into the fluidization chamber 62, such gas flow being chosen so as to fluidize the char. The fluidized char is caused to discharge uniformly over the top edge or weir 40 from each of the wells 28 into the rectangular reactor between the sides 22 thereof and the lower portion 26 of the rectangular slot chamber 12. Once inside the reactor, the fluidized char soon falls into the path of the turbulent slot jet of the coal stream discharging from the lower portion 26 of the slot chamber 12. The coal slot jet is introduced rapidly enough into the reactor to form a jet stream which acts upon the char stream and entrains the particulate char, with complete mixing of the coal and char a short distance inside the reactor. The resulting turbulent jet stream of particulate coal and entrained particulate char expands as indicated by the dotted lines 64 as it passes downwardly through the pyrolysis chamber.

The mixed components of the pyrolysis reaction are conveyed downwardly through the rectangular reactor 20 and the transition chamber 44 therefrom. When the pyrolysis products pass through the slot 45 into inlet pipe 46, the velocity of the mixture is substantially increased while the volume of the mixture is substantially reduced, due to the substantially reduced rectangular cross section of slot 45 as compared to the rectangular cross section of the reactor 20. The mixture of pyrolysis components then passes via inlet pipe 46 and the tangential inlet 50 into the separator 48, the tangential introduction of the pyrolysis or char solids into separator 48 causing a swirling motion of such solids around a portion of the inner periphery of the cylindrical separator. Such char solids are caused to travel one quarter the circumference of the separator or collector 48, as indicated at 66. When the solids reach the near end 67 of the inlet 54 to the duct 52, the solids are propelled tangentially along the dotted line 69 before impacting the outer wall 68 of the solids outlet duct 52, and being removed via outlet conduit 52 and chamber 58 to solids collecting chamber 60. The pyrolysis gases pass through the perforated gas receiver 56 and are withdrawn from the ends thereof.

The above described design of the separator 48 and the tangential location of the inlet 50 and the location of the inlet 54 from the separator to outlet duct 52 provide certain important advantages. It is known to be preferable for improved yields of products, to separate gases from solids in the mixture of the pyrolysis products as soon as possible in order to minimize contact of gases with solids and also to minimize the time that the gases are held at elevated temperature prior to quenching. It is thus seen that in the above separator design, the solids are only maintained in contact with the gases in the separator during the very short period that the solids travel over only one quarter the circumference of the separator until reaching the inlet 54 to the outlet conduit 52, and are then removed from the separator. This is contrary to conventional cyclone operation wherein the solids are maintained in contact with the cyclone wall for several revolutions of the cyclone circumference. Also, the gases remain at the elevated temperature in the separator for only a very short period before being withdrawn therefrom through the gas receiver 56.

The separated char solids removed from the solids collecting chamber 60 or a portion of such solids can be recycled to the wells 28 for fluidization therein, as described above.

A number of variations of the apparatus described above and illustrated in FIG. 1 can be provided utilizing the basic invention principles. Thus, a plurality of reactors can be stacked in parallel with opposed tangential inlets to serve a pair of reactors. Referring to FIG. 3, a pair of slot pyrolysis reactors 20 and associated components, of the type illustrated in FIG. 1, are arranged in parallel side-by-side relation, with the opposed tangential inlets 50 of the two reactors being connected to the separator 48 at opposed 180° positions around the circumference of the reactor, the solids outlet duct 52' in this embodiment, however, being positioned at the lower end of the separator 48 equidistantly around the circumference of the separator from each of the inlets 50.

A system similar to that of FIG. 3 is shown in FIG. 4, but wherein the central fluidization well 28' serves the adjacent pair of reactors 20.

In the embodiment shown in FIG. 5, three reactors 20 and associated components are stacked in parallel, with the intermediate wells 28*a* serving adjacent pairs of reactors, and wherein each of the reactors discharges into its own separator 48.

Referring to FIG. 6, there is shown a modification of the slot chamber 12 of FIG. 1, and wherein an essentially rectangular slot 70 is formed from a number of essentially circular ducts 72 disposed in adjacent side-by-side contacting relation. The stream of particulate coal is fed simultaneously into one end of each of the ducts 72, and the resulting streams discharged from the opposite ends of the ducts 72 into the reactor merge together to form a stream of substantially rectangular cross section.

Although in the preferred embodiment of the invention apparatus as illustrated in FIGS. 1, 1*a* and 2, the lower discharge end of the slot chamber 12 has the same rectangular geometry slot configuration as the rectangular slot inlet at the top of the slot chamber, in FIG. 7 there is shown a modification of slot chamber 74, wherein the lower discharge end 76 is constricted in the form of a rectangular nozzle to form a slot jet or stream having a narrower slot, that is, of smaller rectangular cross section, as compared to the slot jet at the top 78 of the jet chamber. In this embodiment it will be noted that the slot stream of particulate matter, e.g. coal, is further accelerated as it passes through the nozzle 76 and into the pyrolysis reactor.

In FIG. 8, there is shown a modification of the apparatus of FIGS. 1 and 1*a*, wherein the transition chamber 44 is tapered inwardly as at 79 so that the length of the slot 45, inlet 50, the separator 48 and the outlet conduit 52 are all the same, but shorter in length than the reactor 20.

It will be understood that the primary material forming the slot jet can be any particulate material which can be pyrolyzed in the pyrolysis reactor. In preferred practice such primary materials are coal, which can be bituminous or sub-bituminous coals of lignite.

The secondary material for heating the primary material such as coal to a suitable temperature in the pyrolysis reactor is preferably char, particularly recycled char, but can be other materials such as hot particulate inert solids.

From the foregoing, it is seen that the invention provides a novel apparatus and method employing the principle of a slot jet reactor having increased efficiency and capable of producing high yields of products, and which permits simple and practical scaling up for commercial application once an optimum slot length has been selected, by extending the slot length or by stacking a plurality of slot pyrolysis reactors in parallel, as described.

While I have described particular embodiments of my invention for purposes of illustration, it is understood that other modifications and variations will occur to those skilled in the art, and the invention accordingly is not to be taken as limited except by the scope of the appended claims.

What is claimed is:

1. Pyrolysis unit comprising means forming a rectangular slot for formation of a slot stream of a particulate primary material to be pyrolyzed, a substantially rectangular pyrolysis reactor, said slot communicating with said reactor, means positioned on opposite sides of said reactor and in communication therewith, for introduction of particulate secondary material as heat source, from said last mentioned means to said reactor for admixture therein with said slot stream of particulate primary material, a substantially cylindrical separator, means forming a transition chamber from said reactor, said transition chamber terminating in a rectangular slot, a tangential inlet to said separator and in communication with said last mentioned slot and said transition chamber, a solids outlet conduit positioned not more than about 180° around the circumference of said cylindrical separator from said tangential inlet, and a perforate gas receiver mounted in said separator.

2. Apparatus as defined in claim 1, said first mentioned means being a pair of rectangular wells positioned along opposite sides of the upper portion of said reactor, said wells each comprising pipe means for introducing said particulate secondary material to said well, a fluidizing chamber and means for introducing a fluidizing gas into said fluidizing chamber, and means to permit the fluidized secondary material to overflow from each of said wells into the upper portion of said reactor.

3. Apparatus as defined in claim 2, said reactor having an upper wall portion terminating below the top of said reactor, said last mentioned means comprising said upper wall portion and forming an overflow weir from each of said wells into said pyrolysis reactor.

4. Apparatus as defined in claim 1, said solids outlet conduit being positioned about 90° around the circumference of said cylindrical separator from said tangential inlet, said outlet conduit having a wall at the upper end thereof communicating with said separator, whereby solids injected from said tangential inlet into said separator travel around one quarter of the circumference of said separator before impacting said wall of said outlet conduit for removal therein.

5. Apparatus as defined in claim 1, said perforate gas receiver comprising a porous or perforated tube, said tube being mounted axially within said separator, and permitting removal of gases from an end of said tube.

6. Apparatus as defined in claim 1, said cylindrical separator being disposed with its axis in a horizontal position and having a length equal to horizontal length of said reactor.

7. Apparatus as defined in claim 1, said cylindrical separator being disposed with its axis in a horizontal position and having a length smaller than the horizontal length of said reactor.

8. Apparatus as defined in claim 1, said means forming said rectangular slot being comprised of a plurality of circular ducts positioned in side-by-side contacting relation.

9. Apparatus as defined in claim 2, including a plurality of said pyrolysis units positioned in parallel relation, and wherein those wells positioned between adjacent said units are in operative association with reactors of adjacent units.

10. Apparatus as defined in claim 2, including a pair of said pyrolysis units positioned in parallel relation, but employing a single said separator, said tangential inlets from each of said units being in opposed 180° positions around the circumference of said separator.

11. Apparatus as defined in claim 10, wherein those wells positioned between a pair of said units are in operative association with each of the reactors of said units.

12. Pyrolysis apparatus which comprises means forming a downwardly extending rectangular slot for formation of a slot stream of particulate coal to be pyrolyzed, a substantially rectangular pyrolysis reactor, said slot communicating with the upper end portion of said reactor, a pair of rectangular wells positioned along opposite sides of the upper portion of said reactor, said wells each comprising pipe means for introducing particulate char as heat source to said well, a fluidizing chamber and means for introducing a fluidizing gas to said fluidizing chamber, and means to permit the fluidized char to overflow from each of said wells into the upper portion of said reactor, for admixture therein with said slot stream of particulate coal, a transition chamber depending from the lower end of said rectangular reactor, said transition chamber terminating in a rectangular slot of smaller rectangular cross section than said rectangular reactor, a substantially cylindrical separator disposed with its axis in a horizontal position, a tangential inlet to said separator, a rectangular inlet conduit communicating said last mentioned slot with said tangential inlet to said separator, said last mentioned inlet being of the same length as said last mentioned slot, a solids outlet conduit positioned about 90° around the circumference of said cylindrical separator from said tangential inlet, and depending from said separator, said outlet conduit having a wall at the upper end thereof communicating with said separator, whereby solids injected from said tangential inlet into said separator travel around one quarter of the circumference of said separator before impacting said wall of said outlet conduit for removal therein, and a perforate tubular gas receiver mounted axially in said separator, for removal of the gases from an end thereof.

13. Apparatus as defined in claim 12, said cylindrical separator having a length equal to the horizontal length of said reactor, of said transition chamber and of said rectangular inlet conduit.

14. Apparatus as defined in claim 13, wherein said outlet conduit communicates with said separator through an opening in said separator at the upper end of said outlet conduit.

15. A pyrolysis process which comprises passing a high velocity stream of a particulate primary material to be pyrolyzed through a rectangular slot to form a high velocity slot jet of said particulate material having a rectangular cross section, injecting said slot jet into a substantially rectangular pyrolysis zone, introducing a fluidized particulate secondary material as heat source into said pyrolysis zone and mixing said particulate primary material and said particulate secondary material in said pyrolysis zone, and passing the resulting stream of said mixed particulate primary and secondary materials through said pyrolysis zone and pyrolyzing said mixture therein, passing the resulting stream of pyrolysis products through a chamber having a rectangular cross section which reduces in size in the direction of flow, introducing said stream of pyrolysis products tangentially into a cylindrical separator zone, removing solids from said separator zone after said stream has passed around only a fraction of the circumference of said separator zone and removing gases from said separator zone.

16. The process as defined in claim 15, wherein said fluidized particulate secondary material overflows into said pyrolysis zone from wells on both sides of said rectangular pyrolysis zone.

17. The process as defined in claim 15, said solids being removed from an outlet conduit communicating with said separator zone at a location between about 90° and about 180° around the circumference of said cylindrical separator zone from the location of said tangential introduction of said stream of pyrolysis products into said separator zone.

18. The process as defined in claim 17, said stream of pyrolysis products being introduced tangentially through a tangential inlet to said separator zone, said inlet extending substantially the entire length of said cylindrical separator zone, and said outlet conduit being tangentially disposed with respect to said cylindrical separator zone.

19. The process as defined in claim 18, the length of the reduced rectangular cross section of said stream of pyrolysis products being substantially the length of said tangential inlet to said cylindrical separator zone.

20. The process as defined in claim 15, said gases being removed from said separator zone through a perforate tube therein.

21. The process as defined in claim 15, said particulate primary material being particulate coal and said particulate secondary material being particulate char.

22. The proces as defined in claim 19, said particulate primary material being particulate coal and said particulate secondary material being particulate char.

23. Pyrolysis unit comprising means forming a rectangular slot for formation of a slot stream of a particulate primary material to be pyrolyzed, a substantially rectangular pyrolysis reactor, said slot communicating with said reactor, means positioned on opposite sides of said reactor and in communication therewith, for introduction of particulate secondary material as heat source, from said last mentioned means to said reactor for admixture therein with said slot stream of particulate primary material, a substantially cylindrical separator, means forming a transition chamber from said reactor, said transition chamber terminating in a rectangular slot of smaller rectangular cross-section than said rectangular reactor, a tangential inlet to said separator and in communication with said transition chamber, and a rectangular inlet conduit communicating said last mentioned slot with said inlet to said separator, said last mentioned inlet being of the same length as said last mentioned slot, a solids outlet conduit positioned not more than about 180° around the circumference of said cylindrical separator from said tangential inlet, and a perforate gas receiver mounted in said separator.

24. Apparatus as defined in claim 23, said solids outlet conduit being positioned about 90° around the circumference of said cylindrical separator from said tangential inlet, said outlet conduit having a wall at the upper end thereof communicating with said separator, whereby solids injected from said tangential inlet into said separator travel around one quarter of the circumference of said separator before impacting said wall of said outlet conduit for removal therein.

25. Apparatus as defined in claim 23, said cylindrical separator being disposed with its axis in a horizontal position and having a length equal to the horizontal length of said reactor, of said transition chamber and of said rectangular inlet conduit.

26. Apparatus as defined in claim 25, said solids outlet conduit being positioned about 90° around the circumference of said cylindrical separator from said tangential inlet, said outlet conduit having a wall at the upper end thereof communicating with said separator, whereby solids injected from said tangential inlet into said separator travel around one quarter of the circumference of said separator before impacting said wall of said outlet conduit for removal therein.

27. Pyrolysis unit comprising means forming a rectangular slot for formation of a slot stream of a particulate primary material to be pyrolyzed, a substantially rectangular pyrolysis reactor, said slot communicating with said reactor, means in communication with said reactor for introduction of particulate secondary material as heat source into said reactor for admixture therein with said slot stream of particulate primary material, a substantially cylindrical separator for separating solids and gases, means forming a transition chamber from said reactor, said transition chamber terminating in a rectangular slot, a tangential inlet to said separator and in communication with said rectangular slot in said transition chamber, and a solids outlet conduit from said separator and means for withdrawing gas from said separator.

28. Pyrolysis unit comprising means forming a rectangular slot for formation of a slot stream of a particulate primary material to be pyrolyzed, a substantially rectangular pyrolysis reactor, said slot communicating with said reactor, means in communication with said reactor for introduction of particulate secondary material as heat source into said reactor for admixture therein with said slot stream of particulate primary material, and substantially cylindrical separator means for separating solids and gases, said separator means communicating with said reactor.

29. Apparatus as defined in claim 28, including means forming a transition chamber from said reactor, said transition chamber terminating in a rectangular slot, said separator means communicating with said last mentioned slot and said transition chamber.

30. Apparatus as defined in claim 29, said transition chamber terminating in a rectangular slot of smaller rectangular cross section than said rectangular reactor, an inlet to said separator means, and a rectangular inlet conduit communicating said last mentioned slot with said inlet to said separator means, said last mentioned inlet being of the same length as said last mentioned slot.

31. Apparatus as defined in claim 28, said first mentioned means being a pair of rectangular wells positioned along opposite sides of the upper portion of said reactor, said wells each comprising pipe means for introducing said particulate secondary material to said well, a fluidizing chamber and means for introducing a fluidizing gas into said fluidizing chamber, and means to permit the fluidized secondary material to overflow from each of said wells into the upper portion of said reactor.

32. Apparatus as defined in claim 31, said reactor having an upper wall portion terminating below the top of said reactor, said last mentioned means comprising said upper wall portion and forming an overflow weir from each of said wells into said pyrolysis reactor.

33. A pyrolysis process which comprises passing a high velocity stream of a particulate primary material to be pyrolyzed through a rectangular slot to form a high velocity slot jet of said particulate material having a rectangular cross section. injecting said slot jet into a substantially rectangular pyrolysis zone, introducing a fluidized particulate secondary material as heat source into said pyrolysis zone and mixing said particulate primary material and said particulate secondary material in said pyrolysis zone, and passing the resulting stream of said mixed particulate primary and secondary materials through said pyrolysis zone and pyrolyzing said mixture therein, passing the resulting stream of pyrolysis products into a substantially cylindrical separator zone, removing solids from said separator zone and removing gases from said separator zone.

34. The process as defined in claim 33, including passing said stream of pyrolysis products through a chamber having a rectangular cross section which reduces in size in the direction of flow, prior to introducing said stream of pyrolysis products into said separator zone.

35. The process as defined in claim 33, wherein said fluidized particulate secondary material overflows into said pyrolysis zone from wells on both sides of said rectangular pyrolysis zone.

36. The process as defined in claim 33, said particulate primary material being particulate coal and said particulate secondary material being particulate char.

* * * * *